United States Patent [19]

Stewart-Cox

[11] Patent Number: 4,553,555

[45] Date of Patent: Nov. 19, 1985

[54] CIGARETTE MAKING MACHINES

[75] Inventor: Adrian R. Stewart-Cox, Eastleigh, England

[73] Assignee: British-American Tobacco Company Limited, London, England

[21] Appl. No.: 578,778

[22] Filed: Feb. 9, 1984

Related U.S. Application Data

[63] Continuation-in-part of Ser. No. 543,127, Oct. 18, 1983, abandoned.

[30] Foreign Application Priority Data

Oct. 19, 1982 [GB] United Kingdom ..... 8229842

[51] Int. Cl.[4] ..... A24C 5/39

[52] U.S. Cl. ..... 131/110; 131/84.3; 131/108; 131/109.2

[58] Field of Search ..... 131/108, 109 R, 109 B, 131/109 AB, 110, 84 R, 84 B, 84 C, 304, 306; 406/89, 91, 85, 95, 138, 142

[56] References Cited

U.S. PATENT DOCUMENTS

| | | | |
|---|---|---|---|
| 3,877,469 | 4/1975 | Wochnowski et al. | 131/304 |
| 4,235,248 | 11/1980 | Schumacher | 131/108 |
| 4,330,001 | 5/1982 | Hodsall | 131/108 |
| 4,390,029 | 6/1983 | Leckhand et al. | 131/108 |
| 4,417,594 | 11/1983 | Garrone | 131/110 |
| 4,463,768 | 8/1984 | Quarella | 131/108 |

FOREIGN PATENT DOCUMENTS

| | | | |
|---|---|---|---|
| 1550835 | 8/1979 | United Kingdom | 131/304 |

*Primary Examiner*—V. Millin
*Assistant Examiner*—H. Macey
*Attorney, Agent, or Firm*—Kane, Dalsimer, Kane, Sullivan and Kurucz

[57] ABSTRACT

The disclosure is of improved apparatus and a method for producing tobacco rod from cut tobacco filler. The apparatus and the method include the use of a fluid bed of the tobacco particles to convey the tobacco particles from a source to the rod making machine.

6 Claims, 5 Drawing Figures

CIGARETTE MAKING MACHINES

BACKGROUND OF THE INVENTION

This application is a continuation-in-part of copending application Ser. No. 543,127 filed Oct. 18, 1983 and now abandoned.

FIELD OF THE INVENTION

This invention relates to cigarette making machines operable to produce tobacco rod comprising cut tobacco filler wrapped in a paper or other wrapper.

BRIEF DESCRIPTION OF THE PRIOR ART

The established technique for the machine production of cigarettes is to feed a stream of cut tobacco and a continuous web of wrapper to rod forming assembly, commonly called a garniture, operable to wrap and seam seal the wrapper web about the tobacco to provide a tobacco rod which, after the rod has passed out of the rod forming assembly, is cut into cigarette lengths. Many proposals have been made for conveying means to convey tobacco from its entry point to the cigarette making machine and to supply the tobacco to the rod forming assembly as a continuous, homogeneous stream with a maximum degree of separation of the tobacco particles. A currently employed conveying means comprises an elevator which serves to lift tobacco out of a hopper and to feed it to a carded drum which conveys tobacco first to a refuser drum, which acts to level off the carpet of tobacco carried at the periphery of the carded drum, and then to a picker roller. Pins projecting radially from the surface of the picker roller interdigitate with the carding of the carded drum. The pins travel in the same direction as the carding but at a higher speed and thus serve to remove the tobacco from the carded drum. The tobacco so removed is thrown by the picker roller into an airstream directed towards the lower, entry end of an upwardly extending passage, commonly referred to as a chimney. The tobacco is conveyed up the chimney, as separated particles, by the airstream and is, at the upper, exit end of the chimney, deposited at the under surface of the lower run of an endless, perforated band. The tobacco is held on the band under the action of a partial vacuum which is maintained above the lower run of the band. The thus formed continuous stream of tobacco is fed forwardly by the band to the entry end of a garniture.

It is a defect of prior proposed tobacco conveying means in cigarette making machines that a very considerable amount of work is done on the tobacco during the handling thereof by the component elements of the conveying means. This results in a significant degree of degradation of the tobacco. Some forms of smoking materials, expanded tobaccos for example, tend to be more friable than standard cut tobacco at comparable moisture contents and are thus even more susceptible to degradation.

The present invention has as an object the provision of means whereby the degree of degradation suffered by a smoking material during its conveyance in a cigarette making machine to a rod forming assembly thereof is of a low order.

SUMMARY OF THE INVENTION

The present invention provides in a cigarette making machine comprising a rod forming assembly, tobacco supply means, and tobacco conveying means operable to convey tobacco from said supply means to said rod forming assembly, a fluid bed particle separator as a component of said conveying means.

The fluid bed particle separator is operable to maintain tobacco in a fluidized state whereby tobacco particle separation is effected without the tobacco being subjected to the substantial degree of handling work which is a feature of prior proposed mechanical separation devices in cigarette making machine tobacco conveying means.

Air or other fluidizing medium supplied to the fluid bed particle separator may be pre-conditioned to an appropriate moisture level and temperature in order to ensure that the tobacco is conditioned to an appropriate moisture level and temperature during its passage through the separator.

BRIEF DESCRIPTION OF THE DRAWINGS

In order that the present invention may be clearly understood and readily carried into effect, reference will now be made, by way of example, to the accompanying diagrammatic drawings, in which.

DETAILED DESCRIPTION OF THE INVENTION

Figure 1:
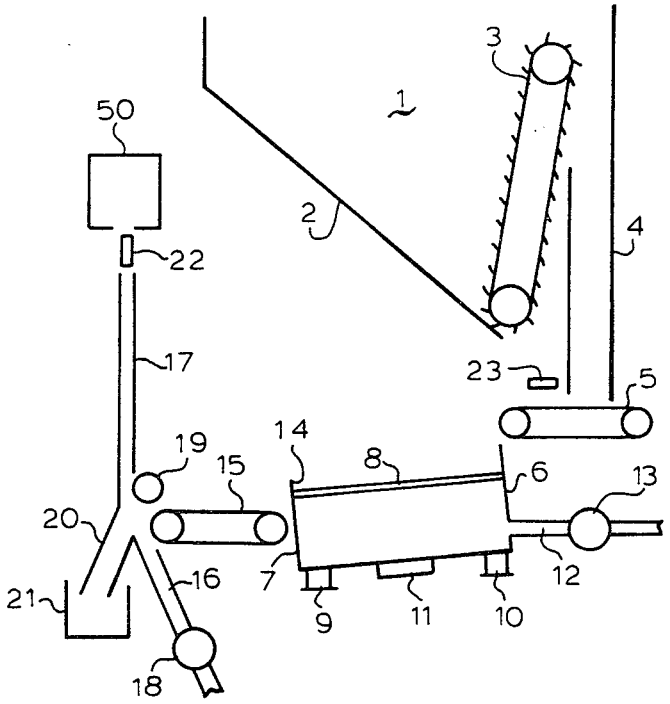
FIG. 1 shows in end elevation tobacco conveying means of a cigarette making machine.

The cigarette making machine tobacco conveying means depicted diagrammatically in FIG. 1 comprises a hopper 1 partly defined by a wall 2 and a run of an elevator 3. The elevator 3 is operable to lift tobacco from the hopper 1 and feed the tobacco to a chute 4 which extends downwardly to a band conveyor 5 which in operation serves to feed tobacco from the lower, exit end of the chute 4 to a fluid bed particle separator 6.

The separator 6 comprises a casing 7 across which is secured an air permeable membrane 8. The casing 7 is provided with flexible mounts 9, 10 and has secured to it a vibrator motor 11. Air under pressure may be continuously supplied to the casing 7 beneath the membrane 8 via a flexible duct 12 from a blower 13. When air is supplied to the casing 7 it passes through the membrane 8 into contact with tobacco fed to the separator 7 from the conveyor 5. Because it is arranged that the velocity of the air passing upwardly from the membrane 8 is in excess of the incipient fluidizing velocity of the bed of tobacco above the membrane 8 but lower than the entrainment velocity, the bed of tobacco is maintained in a state of fluidization.

As may be observed from FIG. 1, the separator 6 is inclined downwardly in a direction away from the conveyor 5. Because the separator 6 is inclined and because the separator 6 has vibratory movement imparted to it by operation of the vibrator motor 11, tobacco is conveyed by gravity in a fluidized bed above the membrane 8 and passes from the separator 6 over an outlet weir 14.

The height of the weir 14 may be adjustable in order to vary the flow rate of tobacco particles from the separator 6. Instead of providing an upwardly extending weir, a downwardly extending outlet weir, with a lower end clear of the membrane 8, could be provided. Alternatively, it could be arranged that the separator 6 is not provided with an outlet weir.

By maintaining cut tobacco in a fluidized state during its passage through the separator 6, a separation of tobacco particles is effected whilst the higher degree of mechanical handling associated with prior proposed separation processes, carding plus picking for example, is avoided. The fluid bed separator 6 is moreover less sensitive to damage from metallic and other hard foreign articles which may find their way into the tobacco feed.

A band conveyor 15 is positioned for receiving tobacco from the separator 6 and for depositing the tobacco into an airstream issued from a duct 16 and directed towards the lower, entry end of a chimney 17. The airstream may be generated by a blower 18. A rotary suction cylinder 19 facilitates entrainment of the particles of cut tobacco in the airstream so that all but the heavier particles are conveyed pneumatically up the chimney 17. Heavy tobacco particles, known as winnowings, descend down a passage 20 to a winnowings receptacle 21.

The particles of tobacco conveyed up the chimney 17 are deposited at the under surface of the lower run of a suction band 22. The thus formed continuous stream of tobacco particles is fed by the suction band to a rod making garniture 50.

The arrangement of the components 16, 17, 19, 20, 22 and the garniture 50 accords with well known practice. It is also known practice to trim excess tobacco from the stream thereof carried by the suction band and to return the excess tobacco to a location of the main tobacco conveyance path upstream of entry to the chimney. Thus in FIG. 1 reference numeral 23 designates a band conveyor which extends in a direction transverse to the conveyor 5 and serves to feed onto the conveyor 5 excess tobacco trimmed off at the suction band 22 by trimming means (not shown).

Figure 2:
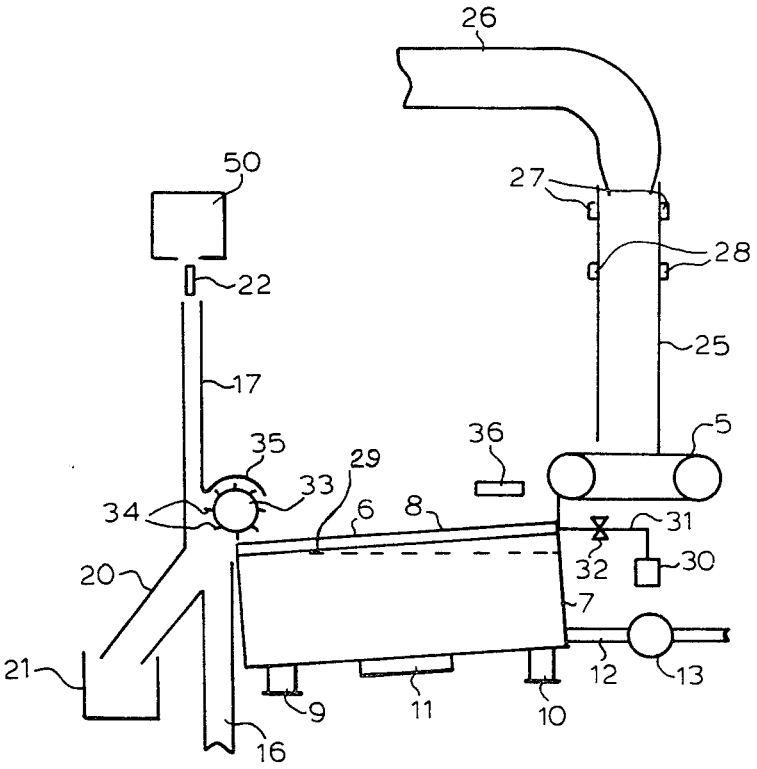
FIG. 2 shows tobacco conveying means differing in some features thereof from the tobacco conveying means of FIG. 1.

In some respects the cigarette making machine tobacco conveying means depicted in FIG. 2 resembles that of FIG. 1. Like elements have been assigned like reference numerals.

A chute 25 is arranged to receive cut tobacco from an end tube 26 of a pneumatic tobacco delivery system (other parts of which are now shown) and to direct the tobacco to a band conveyor 5 which in operation serves to feed tobacco to a fluid bed particle separator 6. Reference numerals 27 and 28 designate upper and lower tobacco level detecting devices in conjunction with which feed commence and discontinue signals may be directed to control means (not shown) associated with the above mentioned pneumatic tobacco delivery system.

The separator 6 is similar to that already described with reference to FIG. 1, having a casing 7, provided with flexible mounts 9, 10 and a vibrator motor 11, an air permeable membrane 8 and an associated air supply system comprising a blower 13 communicating with the interior of the casing 7 via a flexible duct 12. The separator shown in FIG. 2 differs from that of FIG. 1 in that the membrane 8 is pivotally mounted on the casing 7 at location 29, i.e., at the outlet end of the separator 6, and a piston-and-cylinder assembly 30 is connected to the other end of the membrane 8 via a lever 31 which is pivoted at 32. By operation of the assembly 30 the inclination of the membrane 8 can be adjusted in order to vary the flow rate of tobacco through the separator 6. The broken line in FIG. 2 indicates a near horizontal disposition of the membrane 8.

A roller 33, provided with radial projections 34, is mounted transversely of the separator 6 in the vicinity of the tobacco outlet location thereof. Drive means (not shown) is operable to rotate the roller 33 in a clockwise direction. It is the function of the roller 33 to cause tobacco particles at the outlet end of the fluidized bed of particles existent over the membrane 8 to be carried into an airstream issued from a duct 16 and directed towards the entry of a chimney 17. Winnowings descend down a passage 20 to a winnowings receptacle 21. The remainder of the tobacco particles travel up the chimney 17 and are deposited on a suction band 22 which feeds the particles to a rod making garniture 50.

A hood 35 extends over the roller 33 from the entry end of the chimney 17.

A band conveyor 36 serves to feed excess tobacco, trimmed off at the suction band 22, to the bed of fluidized tobacco at the separator 6.

As will be appreciated, tobacco passing through the tobacco conveying means of FIG. 2 is subjected to very little mechanical handling work and thus tobacco particle degradation is of a low order.

Figure 3:
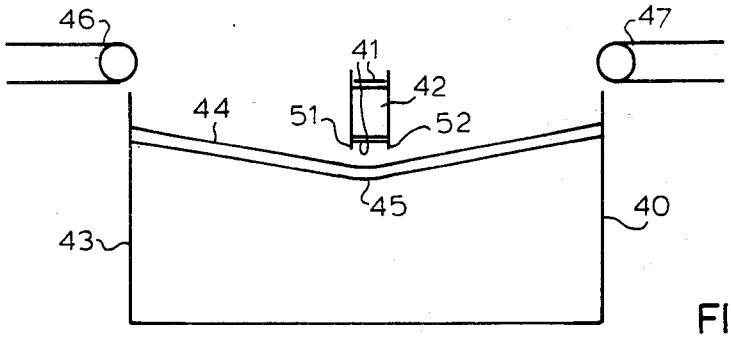
FIG. 3 shows a cross-sectional view taken at line A—A of FIG. 4.
Figure 4:
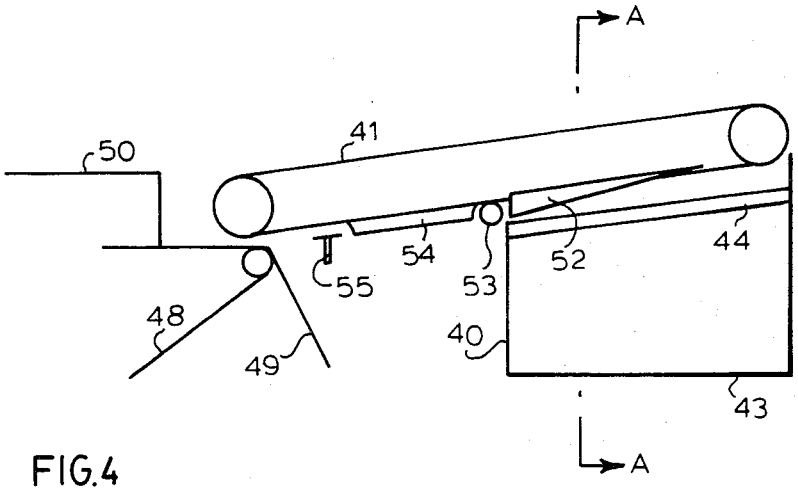
FIG. 4 shows in side elevation a further form of tobacco conveying means of a cigarette making machine.

The cigarette making machine tobacco conveying means depicted in FIGS. 3 and 4 comprises a fluid bed particle separator 40 arranged for the feed of tobacco particles directly on to a suction band 41, the suction chamber associated with which is designated 42. The separator 40 comprises a casing 43 which, as can be seen from FIG. 3, is disposed symmetrically to each side of the suction band 41. An air permeable membrane 44 of the separator 40 is inclined downwardly from each side wall of the casing 43, a central zone 45 of the membrane 44 being disposed at an appropriate spacing beneath the lower run of the suction band 41.

The conveying means of FIGS. 3 and 4 further comprises two band conveyors 46, 47 arranged to feed tobacco at respective sides of the separator 40.

Air supply means (not shown) is arranged to supply air under pressure to the interior of the casing 43.

The suction band 41 is downwardly inclined in the direction of travel of the lower run thereof towards a garniture tape 48 serving to carry paper web 49 and a tobacco particle stream transferred from the suction band 41 through a rod making garniture part of which is indicated at 50. As may be observed from FIG. 4, the membrane 44 has a parallel inclination to the suction band 41.

Side plates 51, 52 of increasing depth in the direction of travel of the lower run of the suction band 41 are disposed one to each side thereof to aid in the formation of a tobacco particle stream on the band 41 as it passes over the separator 40. As the tobacco particle stream is carried on the suction band 41 from the separator 40 to the garniture tape 48, excess tobacco is trimmed off by a pair of side trimming discs, one of which, designated 53, is indicated in FIG. 4. The tobacco particle stream then passes between guide rails, one of which is indicated at 54, and next encounters a further pair of trimming discs, one of which is indicated at 55, arranged to trim the stream to the requisite depth.

In that the separator 40 is arranged for the feed of tobacco particles directly on to the suction band 41, only a minimum of mechanical handling work is carried out on the tobacco particles.

Figure 5:
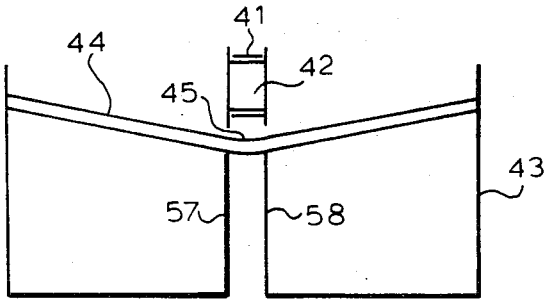
FIG. 5 shows a view similar to that of FIG. 3 but embodying a modification.

The separator shown in FIG. 5 is a modified form of the separator 40 of FIGS. 3 and 4 and thus like parts have been assigned like reference numerals. Walls 57, 58 extend downwardly from each side edge of the central zone 45 of the membrane 44. The space between the walls 57, 58 is open at its lower end and thus under the action of the partial vacuum which is maintained in the suction chamber 42, air may be drawn up through the zone 45 of the membrane 44, the flow of air per unit area through zone 45 being greater than that through the remainder of the membrane 44. The thus established flow of air through zone 45 promotes the ready build-up of a tobacco particle stream on the suction band 41. Respective supplies of fluidizing air flow to the separated portions of the interior of the casing 43 from air supply means (not shown).

Although with the conveying means of FIGS. 3, 4 and 5 the particle separator is arranged to feed tobacco particles directly onto a suction band, the suction band could alternatively be located at the upper end of a chimney the lower end of which is disposed close above the central zone of the particle separator.

What is claimed:

1. A smoking article making machine comprising a rod forming assembly, tobacco supply means, tobacco conveying means operable to convey cut tobacco from said supply means to said rod forming assembly, said conveying means comprising a fluidized-bed particle separator operable to separate particles of cut tobacco, said particle separator comprising a casing, an air permeable membrane extending across said casing, and fluidizing medium supply means operable to supply fluidizing medium under pressure to said casing beneath said membrane.

2. A making machine as claimed in claim 1, wherein said membrane is inclined downwardly in a direction away from said supply means.

3. A making machine as claimed in claim 1, wherein said particle separator somprises outlet weir means adjustable in height to vary the flow rate of separated particles of cut tobacco from said particle separator.

4. A making machine as claimed in claim 1, wherein said conveying means comprises a suction band operable to convey cut tobacco, at the underside of a lower run or said band, to the inlet end of said rod forming assembly, and a tobacco withdrawal zone of said membrane extends in close proximity beneath said lower run of said band whereby, in operation of said machine, separated particles of cut tobacco are transferred directly from said particle separator to said band.

5. A making machine as claimed in claim 4, wherein said particle separator comprises air duct means whereby ambient air may flow to the underside of that portion of said membrane disposed beneath said lower run of said band.

6. A making machine as claimed in claim 4, wherein said particle separator is disposed symmetrically of the direction of travel of said lower run of said suction band.

* * * * *